US007347927B2

(12) United States Patent
Ichitani et al.

(10) Patent No.: US 7,347,927 B2
(45) Date of Patent: Mar. 25, 2008

(54) OIL COMPOSITION FOR HEAT TREATMENT

(75) Inventors: Katsumi Ichitani, Chiba (JP); Makoto Takeishi, Chiba (JP)

(73) Assignee: Idemitsu Kosan Co., Ltd., Tokyo (JP)

( * ) Notice: Subject to any disclaimer, the term of this patent is extended or adjusted under 35 U.S.C. 154(b) by 414 days.

(21) Appl. No.: 10/297,929

(22) PCT Filed: Apr. 26, 2002

(86) PCT No.: PCT/JP02/04245

§ 371 (c)(1),
(2), (4) Date: Dec. 19, 2002

(87) PCT Pub. No.: WO02/090602

PCT Pub. Date: Nov. 14, 2002

(65) Prior Publication Data

US 2003/0201205 A1 Oct. 30, 2003

(30) Foreign Application Priority Data

May 2, 2001 (JP) ..... 2001-134879

(51) Int. Cl.
*C10M 171/02* (2006.01)

(52) U.S. Cl. ..... 208/14; 208/19; 585/1; 148/29; 148/637

(58) Field of Classification Search ..... 208/19, 208/14; 148/29, 637; 585/1
See application file for complete search history.

(56) References Cited

U.S. PATENT DOCUMENTS 3,205,100 A * 9/1965 Morgan et al. ..... 148/637
3,681,150 A * 8/1972 Brewster et al. ..... 148/637
5,250,122 A * 10/1993 Uchida et al. ..... 148/29
5,362,375 A * 11/1994 Kubo et al. ..... 208/19
5,376,186 A * 12/1994 Uchida et al. ..... 148/29

FOREIGN PATENT DOCUMENTS

| | | |
|---|---|---|
| JP | 51-39647 | 10/1976 |
| JP | 7-54038 | 2/1995 |
| JP | 8-157857 | 6/1996 |
| JP | 9-176728 | 7/1997 |
| JP | 10-158677 | 6/1998 |

OTHER PUBLICATIONS

Perry, R. H., Chilton, C. H., Chemical Engineers' Handbook, Fifth Edition, McGraw Hill, New York, p. 1-27.*
Creosote Oil, Eastern Tar Pvt. Ltd., Web Page 1 of 1.*

* cited by examiner

*Primary Examiner*—Glenn Caldarola
*Assistant Examiner*—Prem C. Singh
(74) *Attorney, Agent, or Firm*—Oblon, Spivak, McClelland, Maier & Neustadt, P.C.

(57) ABSTRACT

A heat treatment oil composition comprising a mixed base oil containing 50-95 weight % of (A) a low viscosity base oil with kinematic viscosity of 5-60 $mm^2/s$ at 40° C., and 50-5 weight % of (B) a high viscosity base oil with kinematic viscosity of more than 300 $mm^2/s$ at 40° C. is proposed. By the use of this heat treatment oil composition for hardening of metallic material, it enables to generate little cooling unevenness, to assure the hardness of hardening processed product, and to reduce quenching distortion.

8 Claims, 1 Drawing Sheet

OIL COMPOSITION FOR HEAT TREATMENT

FIELD OF THE INVENTION

The present invention relates to a heat treatment oil composition. More particularly, the invention relates to the heat treatment oil composition used in hardening of metallic material preventing to generate cooling unevenness, assuring hardness of hardening processed product, and enabling to reduce quenching distortion.

BACKGROUND OF THE INVENTION

For a metallic material like steel product, heat treatments such as hardening, tempering, annealing, normalizing are conducted in order to improve the property of the material. Among these heat treatment, hardening is a treatment for the heated steel product in austenite condition, for example, cooling with upper critical cooling rate or more and transforming to a hardened structure such as a martensite. By means of the hardening, processed product becomes very hard. In this case, as a coolant, a heat treatment liquid of oil series, water series (aqueous solution series), or emulsion series is generally adopted.

With regard to the hardening of steel product, in the case of casting the heated steel product into the heat treatment fluid as the coolant, the cooling rate is not constant and the process usually contains three stages. That is, the heated steel product is cooled down through (1) the first stage (vapor blanket stage) where the steel product is surrounded with steam of heat treatment liquid, (2) the second stage (boiling stage) where the vapor blanket breaks and starts boiling and (3) the third stage (convection stage) where the heat is taken away by convection after the temperature of the steel product cooled down to the boiling point or less of the heat treatment fluid. In these three stages, the second grade-boiling stage has the fastest cooling rate.

In conventional heat treatment oil, a heat transfer coefficient showing cooling ability steeply rises particularly in the boiling stage, and an extremely large temperature difference generates in the state that the vapor blanket stage and the boiling stage coexist on the surface of the processed product. Because heat stress or transformation stress appears by differential of thermal contraction or temporal difference of transformation along with the temperature difference, a quenching distortion increases.

FIG. 2 is diagrammatic chart that shows one example of change of coefficient of thermal conductivity by agitation of conventional heat treatment oil. As indicated in FIG. 2, the heat transfer coefficient of the conventional heat treatment oil steeply rises with the decrease of the temperature of the oil below a characteristic temperature.

SUMMARY OF THE INVENTION

The object of the present invention is to overcome these defect of the conventional heat treatment oil, and to provide a heat treatment oil composition for use in hardening of metallic material, with the characteristics of generating little cooling unevenness, ensuring the hardness of the hardening processed product, and enabling to reduce quenching distortion.

The present invention was completed by zealously researching to develop the heat treatment oil composition having the desirable property, and by finding that the use of the mixed base oil of both the low viscosity base oil and the high viscosity base oil having a specified kinematic viscosity and more preferably, that the addition of a vapor blanket-breaking agent to the base oil could achieve the object of the invention. The invention has been completed based on such knowledge.

Therefore, the present invention provides a heat treatment oil composition comprising a mixed base oil containing 50-95 weight % of (A) a low viscosity base oil with kinematic viscosity of 5-60 $mm^2/s$ at 40° C., and 50-5 weight % of (B) a high viscosity base oil with kinematic viscosity of more than 300 $mm^2/s$ at 40° C., and depending on the occasion, further containing (C) a vapor blanket-breaking agent.

DESCRIPTION OF THE PREFERRED EMBODIMENTS

Figure 1:
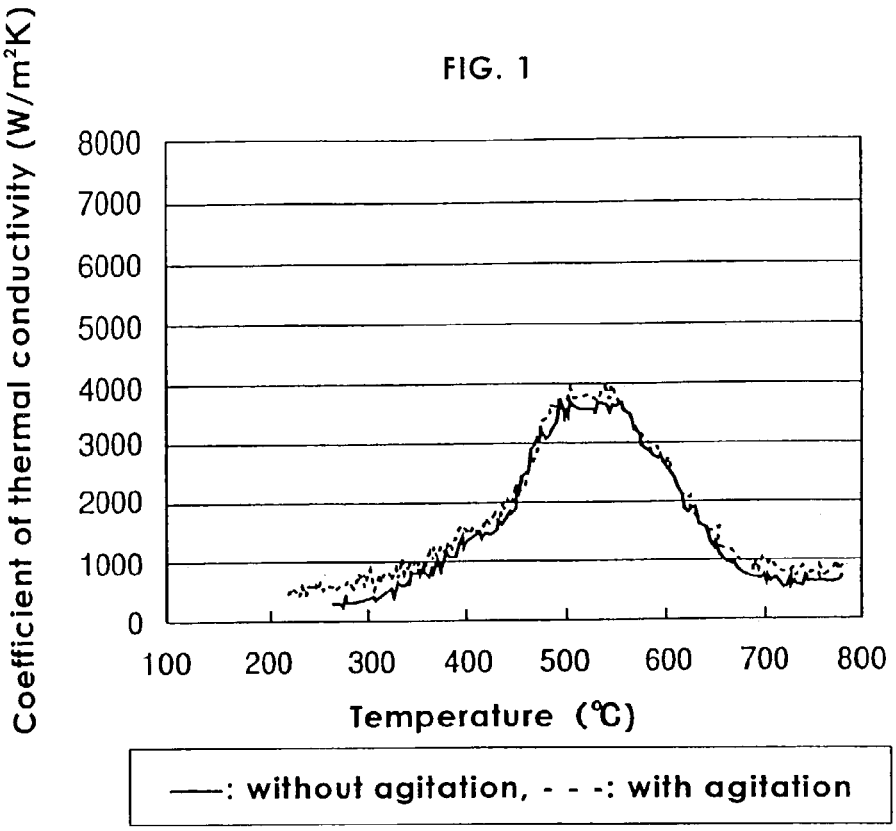
FIG. 1 is diagrammatic chart that shows an example of change of coefficient of thermal conductivity by agitation of heat treatment oil composition of this invention.

In the heat treatment oil composition of the present invention, the mixed base oil contains (A) low viscosity base oil and (B) high viscosity base oil. The kinematic viscosity at 40° C. of the component (A) low viscosity base oil is in the range from 5 to 60 $mm^2/s$.

As for the base oil with the kinematic viscosity of less than 5 $mm^2/s$, it is not appropriate as base oil of heat treatment oil composition because the high volatility, and on the other hand, when the kinematic viscosity exceeds 60 $mm^2/s$, any hardening processed product having enough hardness is not provided. Therefore, the range of the kinematic viscosity is from 5 to 60 $mm^2/s$, and more desirably from 5 to 35 $mm^2/s$.

Further, the kinematic viscosity at 40° C. of the component (B) high viscosity base oil is 300 $mm^2/s$ or more. As for the base oil with the kinematic viscosity of less than 300 $mm^2/s$, the reduction effect against hardening strain is not shown because cooling ability in the boiling stage increases. Moreover, excessively high kinematic viscosity is not desirable from the viewpoint of cooling ability. Therefore, desirable range of the kinematic viscosity is from 400 to 1000 $mm^2/s$.

The present invention, by the use of the mixed base oil comprising the low viscosity base oil and the high viscosity base oil, enables to regulate augmentation of cooling ability in the boiling stage, to reduce quenching distortion, and to broaden the temperature range of the boiling stage. As a result, the hardness of hardening processed product is assured. In order to effectively generate such an advanced performance of the heat treatment oil composition, the mixed base oil of the present invention comprises 50-95 weight % of component (A) low viscosity base oil and 50-5 weight % of component (B) high viscosity base oil. Mineral oil or synthetic oil is used as component (A) low viscosity base oil and component (B) high viscosity base oil. As the mineral oil, whichever of a cut such as paraffin series mineral oil, naphthene series mineral oil, aromatic series mineral oil is applicable and even those passed through what kind of purification method of solvent refining, hydrofining or hydrogenolysis can be employed.

As the synthetic oil, alkylbenzene, alkyl naphthalene, α-olefin oligomer or hindered ester oil can be employed, for example. In the heat treatment oil composition of the present invention, one or more kinds of the foregoing mineral oils, and one or more kinds of the foregoing synthetic oils can be used by combining as component (A) low viscosity base oil and component (B) high viscosity base oil.

Also, more than one kind of the mineral oil and more than one kind of the synthetic oil may be used together. Furthermore, to the heat treatment oil composition of the present invention, a vapor blanket-breaking agent can be blended as component (C). By blending the vapor blanket-breaking agent, the vapor blanket stage can be shortened. Typical examples of the vapor blanket-breaking agent include high molecular polymer such as ethylene-α-olefin copolymer, polyolefin, polymethacrylates or high molecular organic chemical compound like asphaltum etc. and oil dispersed inorganic. These vapor blanket-breaking agents may be used alone or in combination of two or more kinds thereof. The content of the vapor blanket-breaking agents in the heat treatment oil composition is selected usually among 1-10% by weight, preferably among 3-6% by weight. In the case where the content is less than 1 weight %, there is a fear that the effect of adding the vapor blanket-breaking agent is not recognized enough.

On the other hand, in the case where the content exceeds 10 weight %, the viscosity of the heat treatment oil composition increases and the performance of the oil composition deteriorates. The heat treatment oil composition of this invention with such a composition can reduce quenching distortion by cooling unevenness because the vapor blanket stage is short and because the augmentation of cooling ability in the boiling stage is controlled. Moreover, according to the present invention, a temperature range of boiling stage becomes wide, and the sufficient hardness of the processed product is assured.

Figure 2:
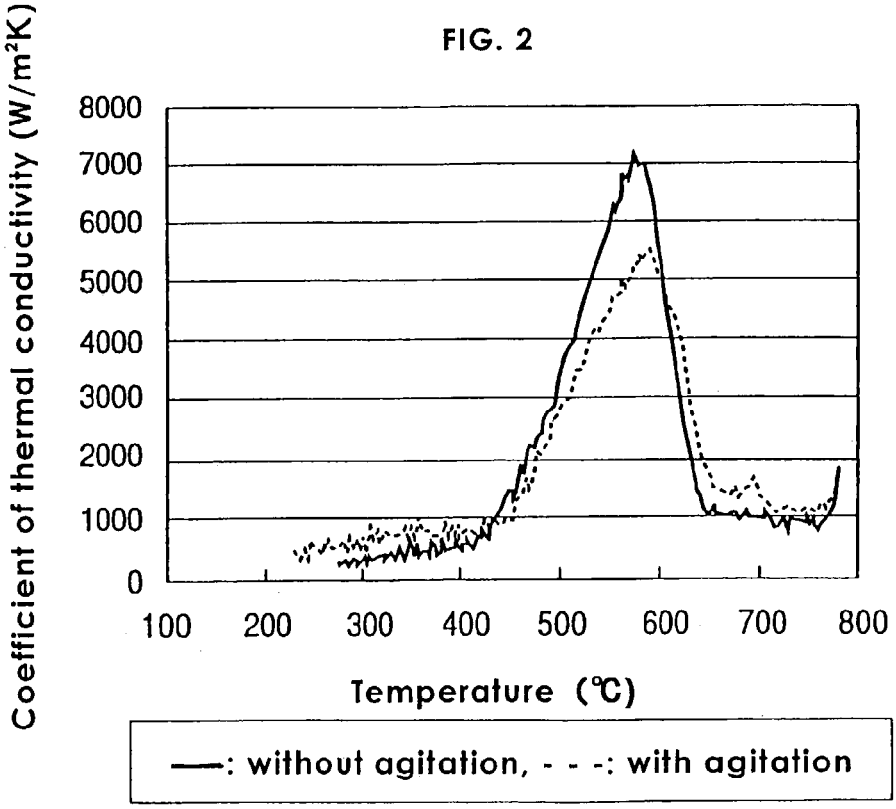
FIG. 2 is diagrammatic chart that shows one example of change of coefficient of thermal conductivity by agitation of conventional heat treatment oil.

FIG. 1 is diagrammatic chart which shows an example of change of coefficient of thermal conductivity by agitation of heat treatment oil composition of this invention. As can be seen from FIG. 1, a rising curve of the coefficient of thermal conductivity in boiling stage is not steep and the temperature range of boiling stage is wide in comparison with the conventional heat treatment oil composition shown in FIG. 2. By the use of the heat treatment oil composition according to this invention, the hardness of the hardening processed product can be increased in comparison with a high viscosity martempering oil causing the same extent of quenching distortion.

As the additives aside from the additives conventionally used for the heat treatment oil, for example, degradation acid neutralizer, oxidation inhibitor, luminosity propensity agent, etc. can be blended depending on the demand to the heat treatment oil composition of this invention within the limit that the object of the invention is achieved. Typical examples of the degradation acid neutralizer include, for example, salicylate of alkaline earth metal, a sulfidation phenate, sulfonate, etc.

As the alkaline earth metal, calcium, barium or magnesium is desirable. Further, typical examples of the oxidation inhibitor include publicly known amine series oxidation inhibitor and hindered phenol series oxidation inhibitor, etc. Furthermore, typical examples of the luminosity propensity agent include publicly known fat and oil, fat and oil fatty acid, alkenyl succinic acid imide, substitution hydroxyl aromatic carboxylate derivative, etc.

EXAMPLES

The present invention shall be explained below in further details with reference to examples, but the invention shall by no means be restricted by the following examples.

The quenching distortion and the hardness of the test pieces after hardening were measured with the method in the following description.

(1) Quenching Distortion

The external diameters of a ring parts as a test piece were measured at the positions of 3 mm from the top and the bottom respectively and a differential value between the average maximum value and the average minimum value at each portion (the average value at the upper part−the average value at the lower part) was defined as a cylindrical distortion. A desired value is 50 μm or less.

(2) Hardness

The center hardness of the ring parts as the test piece was measured by Rockwell-hardness test method prescribed in JISZ2245. A desired value is 36 or more.

Examples 1-4 and Comparative Examples 1-4

After carburizing a processed test piece consisting of ring parts with the outside diameter of 80 mm, the height of 44 mm, and the thickness of 5 mm made of SCM420 for 2.5 hours at 930° C. under carbon potential of 1.1%, a diffusion process was conducted to the test piece for 1.0 hour under carbon potential of 0.8%. Then the temperature of the test piece was decreased to 850° C. and after ignition for 20 minutes, the hardening process was conducted to the test piece by the use of the heat treatment oil composition (100° C.) of the blending composition shown in Table 1. The results are shown in Table 1. In Table 1, data in parentheses means kinematic viscosity at 40° C.

(Annotation)

Low viscosity base oil A-1: Paraffin series mineral oil of 13.5 $mm^2/s$ (40° C.)

Low viscosity base oil A-2: Paraffin series mineral oil of 90.5 $mm^2/s$ (40° C.)

High viscosity base oil B-1: Paraffin series mineral oil of 435 $mm^2/s$ (40° C.)

High viscosity base oil B-2: Paraffin series mineral oil of 781 $mm^2/s$ (40° C.)

Vapor blanket-breaking agent: Polybutene of number average molecular weight 2000

TABLE 1-1

| | | | Examples | | | |
|---|---|---|---|---|---|---|
| | | | 1 | 2 | 3 | 4 |
| Blending composition (weight %) | Low viscosity base oil | A-1(13.5 $mm^2/s$) | 50 | 60 | 80 | 60 |
| | | A-2(90.5 $mm^2/s$) | — | — | — | — |
| | High viscosity base oil | B-1(435 $mm^2/s$) | 50 | 35 | 15 | — |
| | | B-2(781 $mm^2/s$) | — | — | — | 37 |
| | Vapor blanket-breaking agent | | — | 5 | 5 | 3 |
| Performance | Cylindrical distortion (μm) | | 48.5 | 20.1 | 25 | 18.2 |
| | Hardness | | 35 | 38 | 41 | 37 |

TABLE 1-2

| | | | Comparative Examples | | | |
|---|---|---|---|---|---|---|
| | | | 1 | 2 | 3 | 4 |
| Blending composition (weight %) | Low viscosity base oil | A-1(13.5 $mm^2/s$) | 95 | — | 30 | — |
| | | A-2(90.5 $mm^2/s$) | — | — | — | 50 |
| | High viscosity base oil | B-1(435 $mm^2/s$) | — | 95 | 65 | 50 |
| | | B-2(781 $mm^2/s$) | — | — | — | — |
| | Vapor blanket-breaking agent | | 5 | 5 | 5 | — |
| Performance | Cylindrical distortion (μm) | | 179 | 18.2 | 55.9 | 62.5 |
| | Hardness | | 42 | 25 | 28 | 32 |

INDUSTRIAL APPLICABILITY

According to the present invention, a heat treatment oil composition used for hardening of metallic material that generates little cooling unevenness, assures the hardness of hardening processed product, and at the same time, reduces quenching distortion is easily provided.

What is claimed is:

1. A heat treatment oil composition comprising a mixed base oil component containing, by weight based on 100% of (A) and (B), 50-63.2 weight % of (A) a low viscosity base oil component with kinematic viscosity of 5-60 $mm^2/s$ at 40° C., and 50-36.8 weight % of (B) a high viscosity base oil component with kinematic viscosity of 300-1,000 $mm^2/s$ at 40° C., wherein the coefficient of thermal conductivity of the heat treatment oil composition at a temperature of from 500° C. to 600° C. is not more than 4,000 $w/m^2K$.

2. The heat treatment oil composition according to claim 1 wherein said kinematic viscosity at 40° C. of (A) low viscosity base oil component is 5-35 $mm^2/s$, and said kinematic viscosity at 40° C. of (B) high viscosity base oil component is 400-1000 $mm^2/s$.

3. The heat treatment oil composition according to claim 1, further comprising (C) a vapor blanket-breaking agent.

4. The heat treatment oil composition according to claim 3, wherein the contents of (C) vapor blanket-breaking agent is from 1 to 10% by weight.

5. The heat treatment oil composition according to claim 2, further comprising (C) a vapor blanket-breaking agent.

6. The heat treatment oil composition according to claim 5, wherein the contents of(C) vapor blanket-breaking agent is from 1 to 10% by weight.

7. A process comprising hardening a metallic material in the presence of the heat treatment oil composition according to claim 1.

8. The process according to claim 7, wherein the metallic material is steel.

* * * * *